US005857451A

United States Patent [19]

Ciluffo et al.

[11] Patent Number: 5,857,451

[45] Date of Patent: Jan. 12, 1999

[54] LAUNCHER APPARATUS FOR SPHERICAL AND DISC-SHAPED OBJECTS

[76] Inventors: Gary Ciluffo, 103 Henderson Hills, Vincennes, Ind. 47595; John R. Wootton, 700 Rugby Ct., St. Louis, Mo. 63141; J. Joseph Muller, 1623 Missouri Ave., St. Louis, Mo. 63104

[21] Appl. No.: 559,794

[22] Filed: Nov. 15, 1995

[51] Int. Cl.[6] ..... F41B 3/04

[52] U.S. Cl. ..... 124/6

[58] Field of Search ..... 124/4, 6, 45, 46, 124/47, 49, 50

[56] References Cited

U.S. PATENT DOCUMENTS

| | | | |
|---|---|---|---|
| 715,179 | 12/1902 | Troutner | 124/6 |
| 1,408,137 | 2/1922 | Parsons | 124/6 |
| 1,662,629 | 3/1928 | Baden-Powell | 124/6 |
| 3,552,900 | 1/1971 | Newill | 124/6 |
| 3,585,978 | 6/1971 | Hurlimann | 124/6 |
| 3,613,655 | 10/1971 | Tobin et al. | 124/6 |
| 3,822,688 | 7/1974 | Mayne | 124/6 |
| 4,632,086 | 12/1986 | Rutten | 124/6 |
| 4,747,390 | 5/1988 | Storm | 124/6 |

FOREIGN PATENT DOCUMENTS

| | | | |
|---|---|---|---|
| 87964 | 8/1896 | Germany | 124/6 |
| 437359 | 7/1934 | United Kingdom | 124/6 |
| 526908 | 9/1940 | United Kingdom | 124/6 |

*Primary Examiner*—John A. Ricci

*Attorney, Agent, or Firm*—Polster, Lieder Woodruff & Lucchesi LC

[57] ABSTRACT

Apparatus (10) for launching spherical and disc-shaped objects (O) used in the practice or play of a sport. A launcher assembly (12) includes a constantly rotating arm (14) rotatable about a center pivot (P). An object to be launched is loaded into an inlet end (16) of the arm adjacent the pivot for the object to be drawn outwardly by centrifugal force toward an outer end (18) of the arm from which the object is released. The velocity of the object when it is launched is a function of the length of the arm and the speed at which the arm is rotating. A feed assembly (20) holds a number of homogeneous objects. A feed mechanism (100) of the feed assembly is selectively operable to feed the objects into the inlet end of the arm. A control panel (148) enables a user to remotely control operation of the apparatus, to control individual launches, or to preset an interval at which objects are automatically launched. A drive unit (24) includes a motor (26,26') for constantly rotating the arm. The motor's speed is controllable to rotate the arm over a range of speeds so to control the velocity of the object when it is launched.

16 Claims, 7 Drawing Sheets

LAUNCHER APPARATUS FOR SPHERICAL AND DISC-SHAPED OBJECTS

BACKGROUND OF THE INVENTION

This invention relates to ball tossing machines and clay pigeon launchers, and more particularly, to a simple, relatively inexpensive apparatus for launching spherical objects such as baseballs and disc-type objects such as clay pigeons.

In skeet or trap, it is well-known to use a launcher to toss clay pigeons various distances and on different trajectories. Various types of spring traps are used, these being relatively inexpensive. However, they require a great deal of force to cock, and are limited as to launch angle and usually must be hand loaded prior to launch. More sophisticated launchers are used which employ carousels, for example, having slots which hold a large volume of clay pigeons that are automatically fed into a launcher. Such devices are operable so two clay pigeon can be launched in a short enough interval that both are airborne at the same time. Also, these devices enable launch trajectories to be varied. However, these devices cost thousands of dollars, and are usually found only at ranges where competitions are held.

Baseball throwing machines are also well-known and there are various types available. One type uses two counter-rotating wheels with a ball being compressed between the wheels. When released, the compressive forces impart sufficient impetus to the ball to propel it a distance equal to the distance between a pitcher's mound and home plate, the ball traveling at a reasonable speed. A problem with these devices is that they tend to tear the cover off a regular baseball or softball. Accordingly, a special molded plastic, dimpled ball is usually used with these machines, thereby negating the general purpose for which they are designed. Other machines use a lever arm which is rotated or cocked to a loading position at which a ball is placed onto a stationary holder at the end of the arm. The arm is then driven forward by a spring or motor to a release position. In some machines, a motor driven cam rotates the arm through a full 360° with the ball being loaded at one arm position and released at another. None of these machines, however, are capable of doing other than throwing a ball a short distance for batting practice.

Other ball throwing devices are used for tennis practice. These are typically pneumatic devices which, for a compressible tennis ball, forces the ball through and out of a tube whose diameter is slightly smaller than that of the ball so the ball blocks the air flow and builds up a pressure behind the ball which forces it through the tube.

All of these various devices are limited use for one sport only, are of limited usage with respect to that sport. Further, many of these machines are subject to tremendous forces being generated by the prime mover on various components of the device, these forces being required to generate sufficient force on the object to throw it at a reasonable speed. This resulting shock and vibration produced when an object is thrown, tossed, or launched resulting in substantial maintenance being required on the devices, this in addition to their high initial cost.

SUMMARY OF THE INVENTION

Among the several objects of the present invention may be noted the provision of apparatus adapted to throw, toss, or release spherical objects such as baseballs, softballs, tennis balls, squash balls, hand balls, and the like;

the provision of such apparatus to be further adaptable to throw disc-like objects such as clay pigeons and hockey pucks;

the provision of such apparatus to be convertible from throwing one type of object to throwing another;

the provision of such apparatus to employ a constantly rotating arm into one end of which an object to be thrown or launched is loaded, the object then being driven outwardly, by centrifugal force to an outer end of the arm from where it is ejected;

the provision of such apparatus in which the throwing arm is movable both vertically and horizontally so the object to be launched can be thrown at any angle including along the ground;

the provision of such apparatus in which the rotating speed of the arm is variable over a wide range of speeds to control the speed at which an object is launched and the distance the object travels, the distances traveled being on the order of up to 100 yards for clay pigeons and 300 feet to 400 feet for baseballs and, and at speeds ranging up to approximately 90–100 miles per hour;

the provision of such apparatus in the rotating arm acts a flywheel storing kinetic energy whereby the launching of an object requires considerably lower force being required by the prime mover than conventional devices, with considerably less reactive forces being produced;

the provision of such apparatus having a feed mechanism by which an object can be controllably fed into the arm, the feed mechanism being remotely operable by the user, or to have a timed feed which periodically loads an object into the arm;

the provision of such apparatus to be useful in throwing batting practice, infield practice, and outfield practice for baseball and softball, in throwing clay pigeons in the air and on the ground for skeet practice and competition, lob tennis balls over a net for tennis practice, throw a puck along an ice surface for hockey practice, and throw a ball against a wall for handball practice and the like;

the provision of such apparatus in which the feed mechanism is controllable so that two or more objects can be consecutively launched with the time interval between launches so short that both objects are airborne at the same time;

the provision of such apparatus to be readily portable;

the provision of such apparatus to be both powered by a DC motor which is battery operated or operated from an AC power source with an AC-DC converter, the provision of such apparatus which is alternatively operated by an AC motor from an AC power source or from a battery using a DC-AC inverter; and, the provision of such apparatus to be relatively low cost, easy to set up and operate, and which is not subject to a great deal of vibration when launching a ball or disc-shaped object.

The invention, briefly stated, comprises an apparatus for throwing balls such as baseballs, tennis balls, etc., and discs such as clay pigeons and hockey pucks. The apparatus includes a motor driven launch arm, the launch arm being constantly rotating at a desired speed, a feed mechanism for automatically feeding an object to be launched into the arm, and a carriage on which the feed and launch mechanisms are mounted. The arm is constantly turned at speed, being neither stopped nor slowed when an object to be launched is fed into one end of the launch arm. Once loaded onto the arm, the object is pulled outwardly by a combination of centrifugal and gravitational forces along the length of the arm. An outer wall inside of which the launch arm rotates has an opening therein through which the ball or disc is released as the arm sweeps past the opening. The opening is movable to vary the release point. The feed mechanism employs a user operable or automatic release mechanism to feed a ball or disc into the launcher arm. The carriage allows the apparatus to be readily portable. The apparatus is operable using a battery such as a vehicle battery or from an AC electrical outlet through a power converter. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
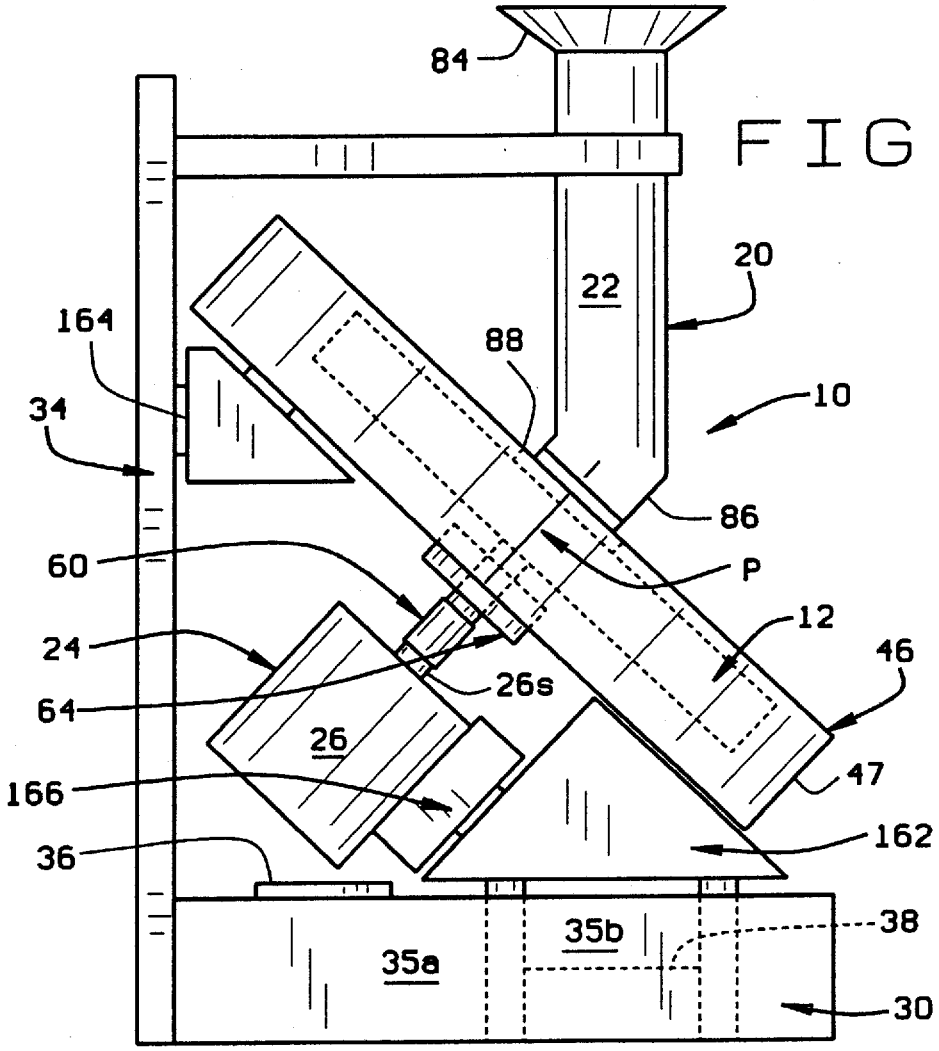
FIG. 1 is an elevational view of apparatus of the present invention for launching an object such as a ball or disc shaped object.
Figure 2:
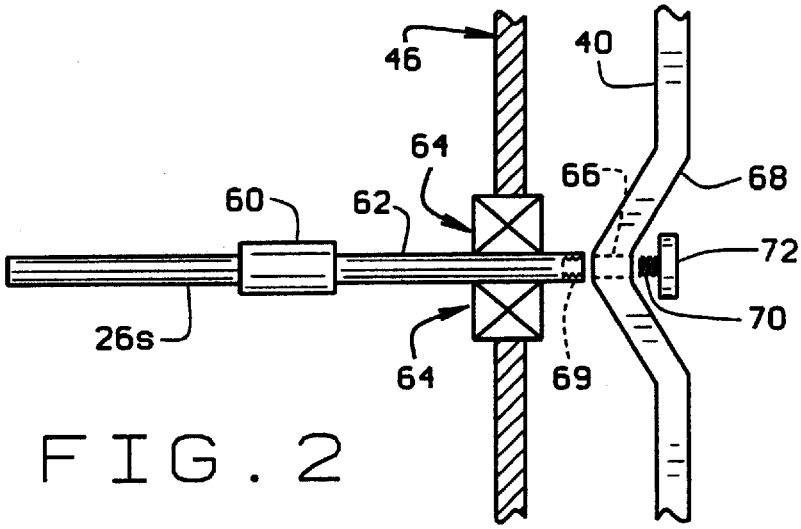
FIG. 2 is a partial elevational view of the apparatus illustrating connection of a drive means of the apparatus to a launch means thereof.

Referring to the drawings, apparatus of the present invention is indicated generally 10. The apparatus is for launching spherical objects such as baseballs, tennis balls, hand balls, etc., and disc-shaped objects such as clay pigeons and hockey pucks. The apparatus comprises a launcher means 12 including a constantly rotating arm 14 rotatable about a center pivot P. An object O, whether spherical or disc-shaped, is loaded into an inlet end 16 of the arm adjacent the pivot. The object is then drawn outwardly, in a spiral path, by centrifugal force, to an outer end 18 of the arm from which the object is released. The length of the arm is, for example, approximately 18" and the release velocity of the object is a function of the length of arm 14 and the speed at which the arm is rotating.

A feed means indicated generally 20 comprises a tubular feed hopper 22 for holding one more balls or discs. When remotely operated by the user, or automatically, an object is delivered from the feed into arm 12. A drive means 24 includes a reversible DC motor 26 for constantly rotating arm 12. The motor is controllable over a range of speeds so to control the launch velocity of the object. Alternatively, the drive means could include a reversible AC motor 26' for constantly rotating the arm.

All of these various means are mounted on a carriage 30. The carriage has wheels 32 (see FIG. 9) for portability so the apparatus can be manually or vehically moved from a storage area to a field or other areas where objects are to be launched. The carriage includes a frame 34 and includes sections 35*a*, 35*b* for mounting a battery 36 used to power the motor and a control electronics 38 of the apparatus.

Figure 3:
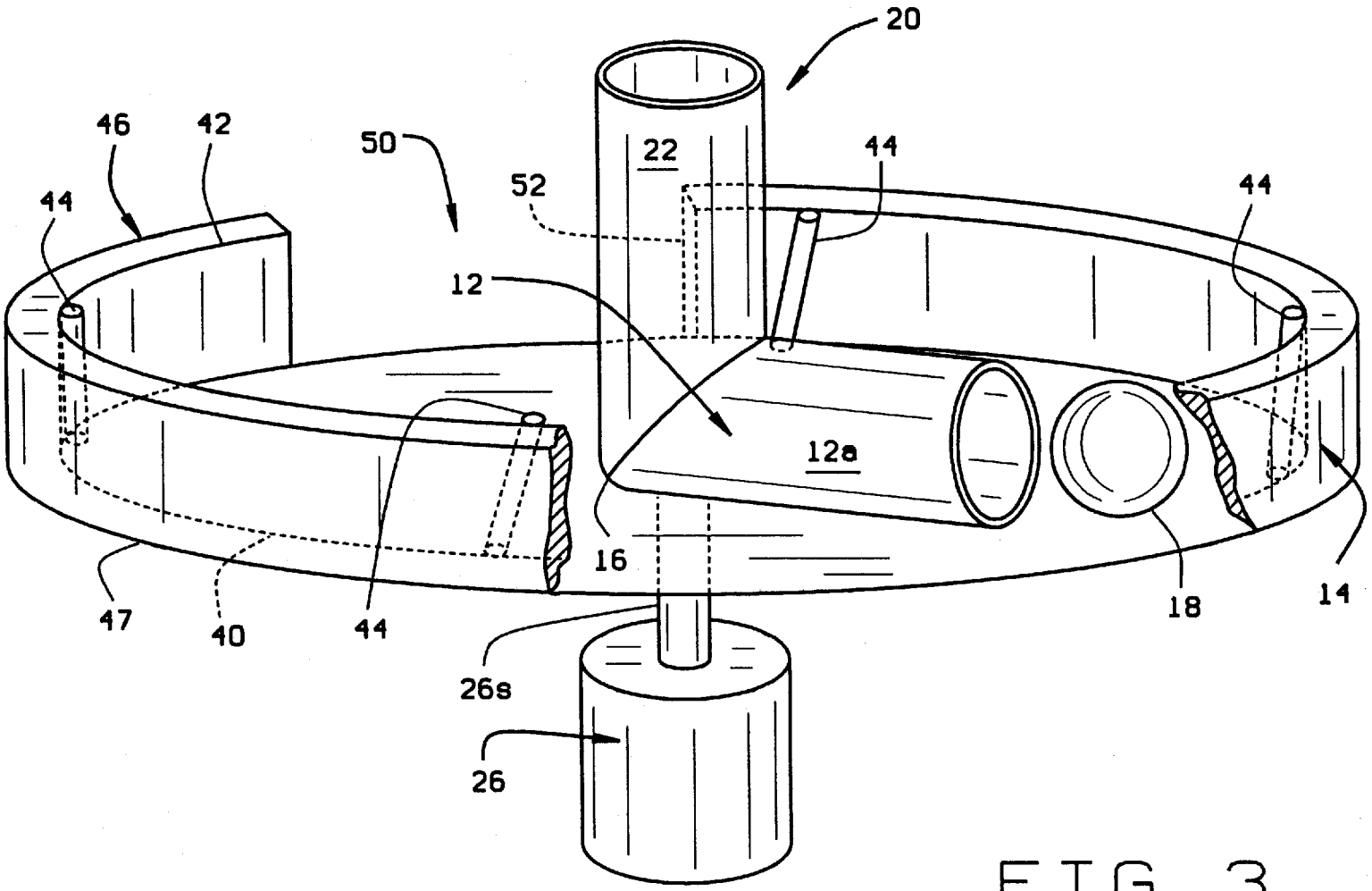
FIG. 3 is a perspective view of one embodiment of a launch means of the apparatus.
Figure 4:
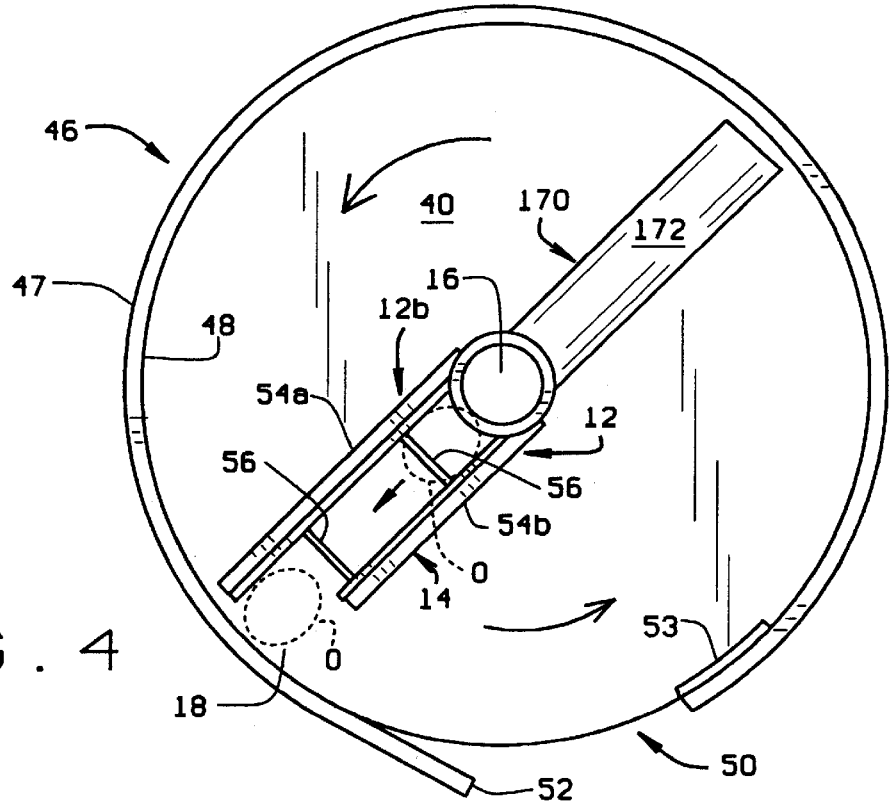
FIG. 4 is a plan view of a second embodiment of the launch means.

In more detail, arm 12 of the launcher means can comprise a tube 12*a* as shown in FIG. 3, or a plate 12*b* as shown in FIG. 4. In either embodiment, the launcher means includes a pair of parallel disc-shaped plates 40 and 42. The plates are held in parallel relationship by spacers 44. It will be understood, however, that with launch arm 12*a* for throwing balls, the plates and spacers may not be required. Further, as shown in FIG. 6B, for a launch arm 12*b* used with discs, plate 40 may simply be a rectangular plate forming the bottom of the arm, and disc 42 a top cover plate of the arm. Or, in this latter instance, plate 42 may not be used. Again, the spacers 44 would not required in such an embodiment. A circumferential housing 46 includes a side sheet 47 extending circumferentially about the plates to the outside of the plates. The object, when it reaches the outer end of the arm 12*a* or 12*b*, contacts and rolls about a wall 48 defined by an inner surface of the sheet as shown in FIG. 4. The sheet has an opening 50 formed therein through which the ball or disc is released. The leading edge 52 of the opening is flared outwardly to form a lip. If desired, the inner face of wall 48 can be lined with a layer 53 of resilient material such as a rubber or rubber compound to absorb any radial forces which are imparted to the object as it moves out to the end of the arm. A partial lining of such material is shown in FIG. 4.

Figure 6A:
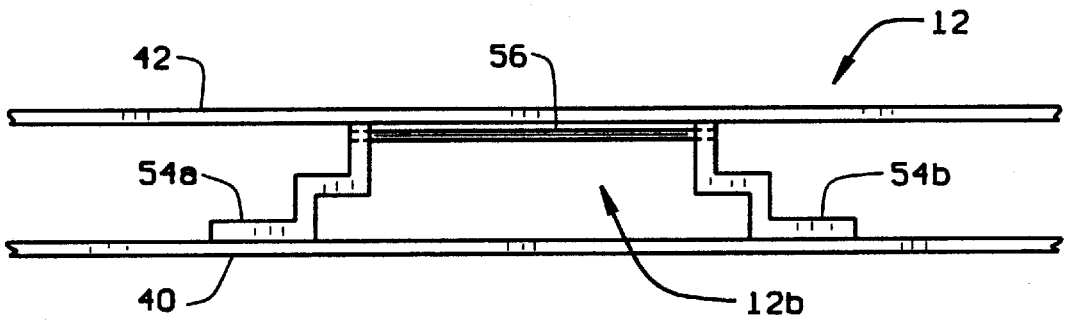
FIG. 6A is a partial elevational view of the second embodiment of the launch means.
Figure 6B:
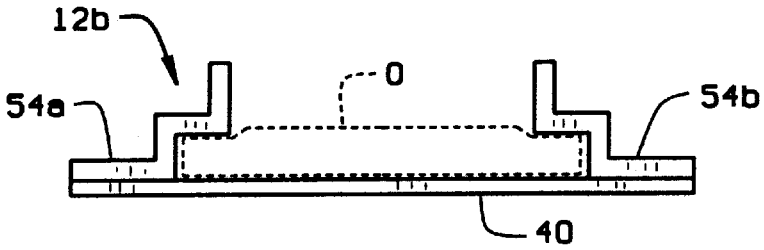
FIG. 6B is a plan view of an alternate second embodiment of the launcher means.

As shown in FIGS. 4, 6A, and 6B, arm 12*b* includes a pair of spaced, parallel channel segments 54*a*, 54*b* which are mounted on plate 40. The segments are generally of an inverted L-shape with the height of the segments being slightly greater than the height of the disc. The spacing between segments corresponds to the diameter of the disc. As shown in FIG. 4, the segment 54*a*, extends the entire length of the arm, whereas the length of segment 54*b* is one diameter length less than that. Thus, when the object reaches the outer end of the arm, it is not constrained and freely releases through the opening 50. If desired, cross pieces 56 extend between the segments to add structural support to the arm.

Figure 11:
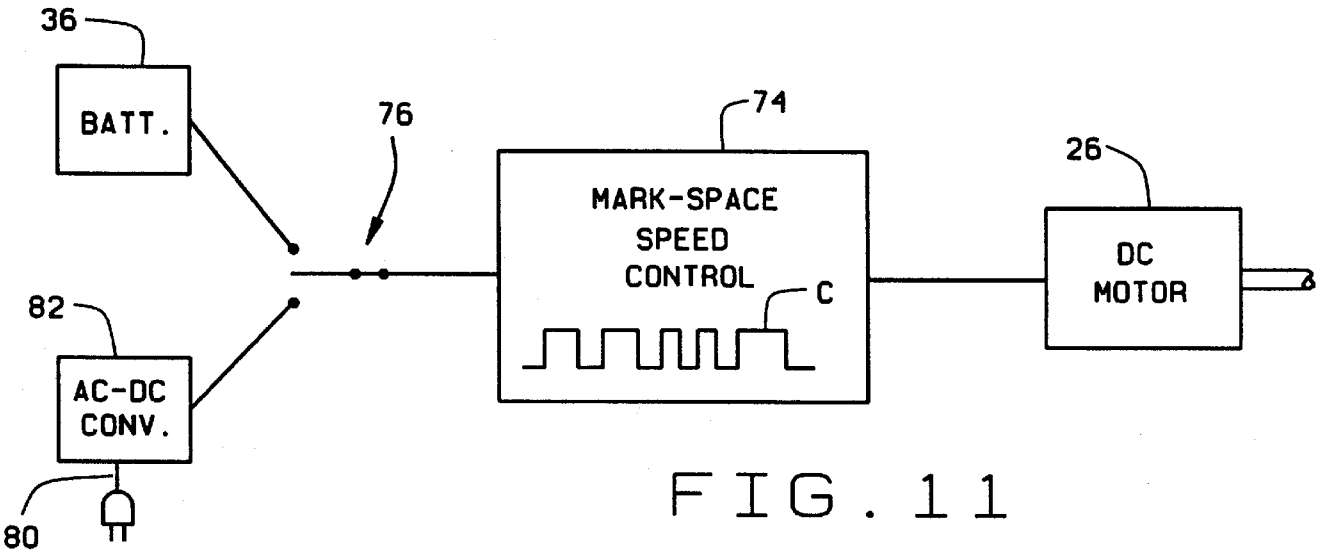
FIG. 11 is a block diagram of an electrical control for running a DC motor used to power the apparatus; and, FIG. 12 is a block diagram of an electrical control for running an AC motor used to power the apparatus.
Figure 12:
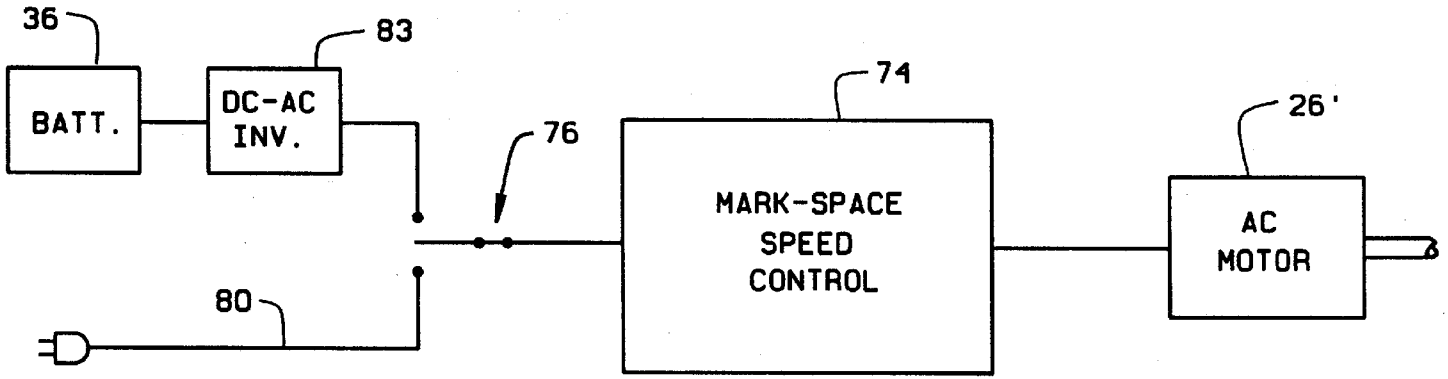

The center of plate 40 comprises a point of connection between motor 26 and the launch arm. A motor shaft 26 is connected to a flexible coupling 60. A connecting shaft 62 extends from coupling 60 through a bearing or bushing 64 to an opening 66 in a countersunk portion 68 of plate 40. The outer end of shaft 62 has a threaded bore 69 into which the screw end 70 of a cap 72 is fitted to attach the motor to the plate. The motor is constantly running so the arm 12 is always rotating at speed. As such, it functions as a flywheel with a substantial amount of inertia. A speed controller 74 such as a mark-space type speed controller controls the motor speed. As shown in FIG. 11, power is supplied to DC motor 26 from battery 36, through a switch 76, and the speed controller. Or, if the apparatus is connected to an AC power source by a power cord 80, through an AC-DC converter 82, the switch, and the speed controller. Controller 74 provides a pulse width modulated output C to motor 26, and the speed of the motor is a function of the relative portion of an interval in which, the pulse is present (MARK) to that in which it is not (SPACE). Alternatively, and as shown in FIG. 12, power is supplied to AC motor 26' from battery 36, through a DC-AC inverter 83, switch 76, and speed controller 74. Or, if the apparatus is connected to an AC power source by power cord 80, through the switch and speed controller.

Feed means 20, as noted, includes a tube 22 which has a diameter corresponding to that of the ball or disc being fed to the launch arm. The length of the tube is such that it can hold a number of balls or discs. Further, an inlet end 84 of the feed tube may be connected to a hopper (not shown) holding more of the objects. Or, the upper end of the feed tube may be funnel shaped to accommodate more of the objects. Regardless, an outlet end 86 of the feed tube is coupled to the inlet end of arm 12 through a coupling 88. The coupling, for example, is fitted in housing 46 which covers the launcher means. A ball or disc fed from the tube into the launch arm is fed through the coupling. Both the housing and coupling are fixed in place and do not rotate with the launcher means.

Figure 5A:
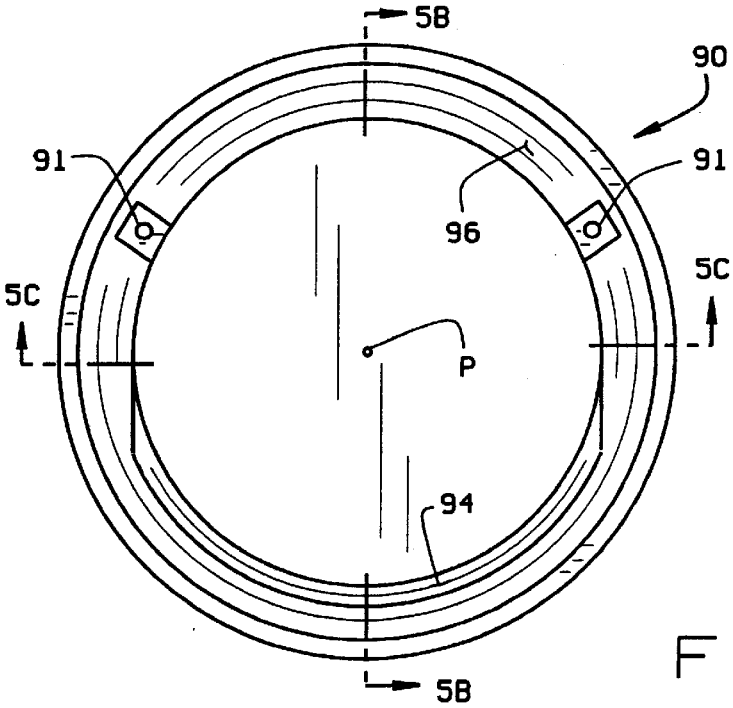
FIG. 5A, 5B, and 5C are respective top, side, and front views of an inlet structure for the second embodiment of the launch means.
Figure 5B:
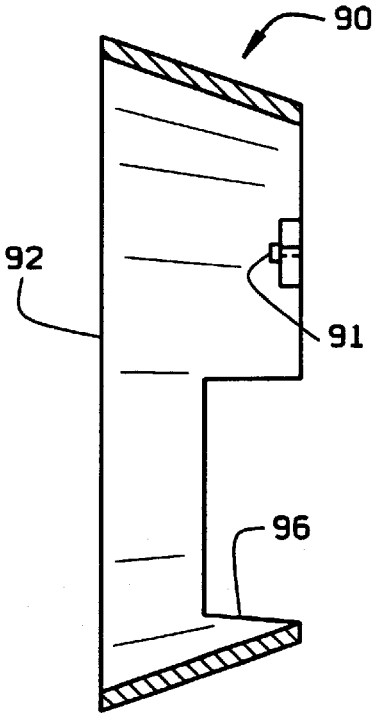
Figure 5C:
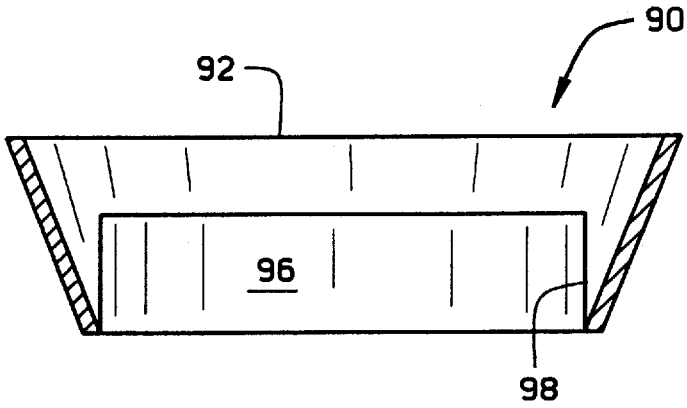

As shown in FIGS. 5A–5C, a feed unit 90 is used with launch arm 12 to load discs into the inlet end of the feed arm. The unit is mounted to plate 40 by screws 91 so as to be centered about pivot P. The unit is circular in plan with an opening 92 in its top through which a clay pigeon, hockey puck, or other disc-shaped object falls when fed from the feed tube. One section 94 of the unit sidewall 96 is tapered inwardly to facilitate feeding of the disc and to have the disc fall onto plate 40 centrally about pivot P. The disc is then free to move outwardly along the length of arm 12 under centrifugal and gravitational force. As shown in FIGS. 5B and 5C, the unit has a generally rectangular opening 98 formed in the base of the unit. This opening is aligned with the inlet end of launch arm 12 for the clay or puck to slide from the unit into the launch arm.

Figure 7:
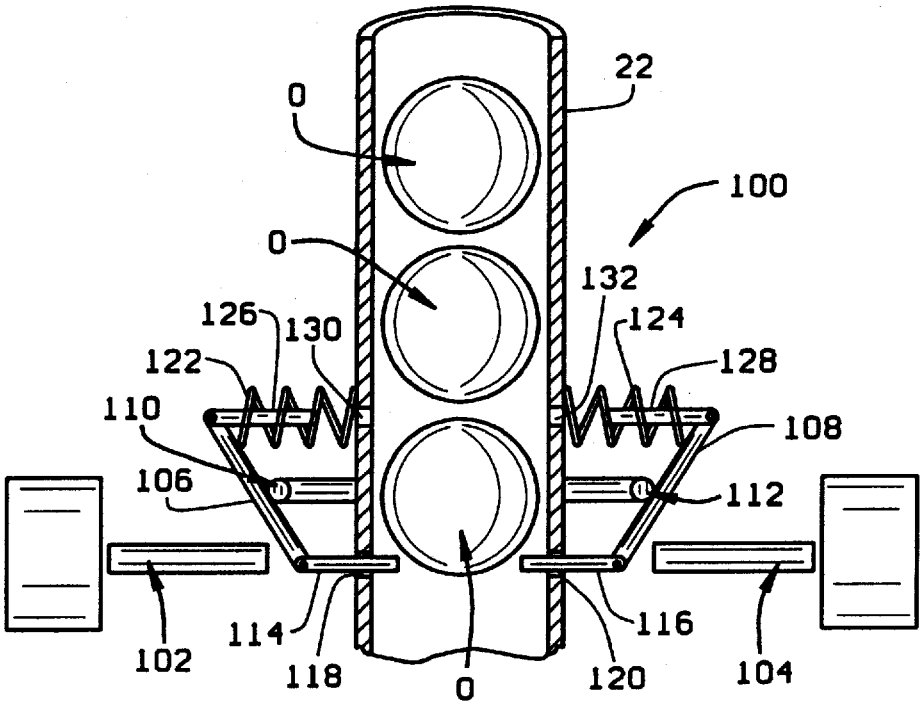
FIG. 7 is a first view of a release mechanism for feeding an object into the launch means.

A feed mechanism 100 (see FIGS. 7 and 8) for feeding balls or discs from the feed tube to the launch arm includes opposed solenoids 102 and 104 positioned adjacent the outlet end of the feed tube. Each solenoid operates a respective center pivot lever arm 106 and 108. The pivot is formed by a post 110 or 112. The end of the lever arm adjacent the solenoid includes a pin 114 and 116 which extend through respective openings 118 and 120 in the side of the tube. The outer ends of the respective arms are spring loaded by springs 122 and 124. When the solenoids are at their maximum stroke as shown in FIG. 7, pins 114 and 116 extend across the bottom of the feed tube and prevent a ball or disc O from being delivered from tube 22 into launch arm 12.

Figure 8:
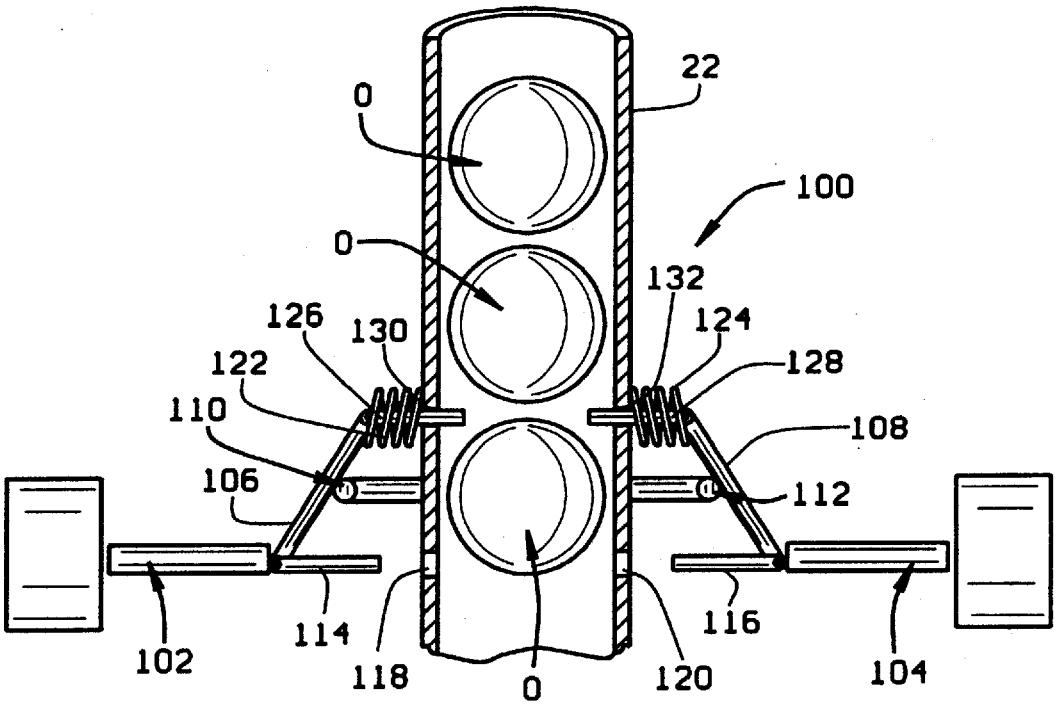
FIG. 8 is a second view of the release mechanism.

When the solenoids are retracted to their minimum stroke as shown in FIG. 8, pins 114 and 116 are withdrawn from the tube. As the lever arm pivots, pins 126 and 128 attached to the opposite end of the lever arms are inserted into the tube, above the ball or disc, through respective openings 130 and 132. This allows the ball or disc previously held in place to fall into the inlet end of the launch arm. At the same time, the remaining balls or discs are held in place. When the solenoid is returned to its FIG. 7 position, the balls or discs drop so the next ball or disc to be delivered is now at the lower end of the feed tube.

Figure 9:
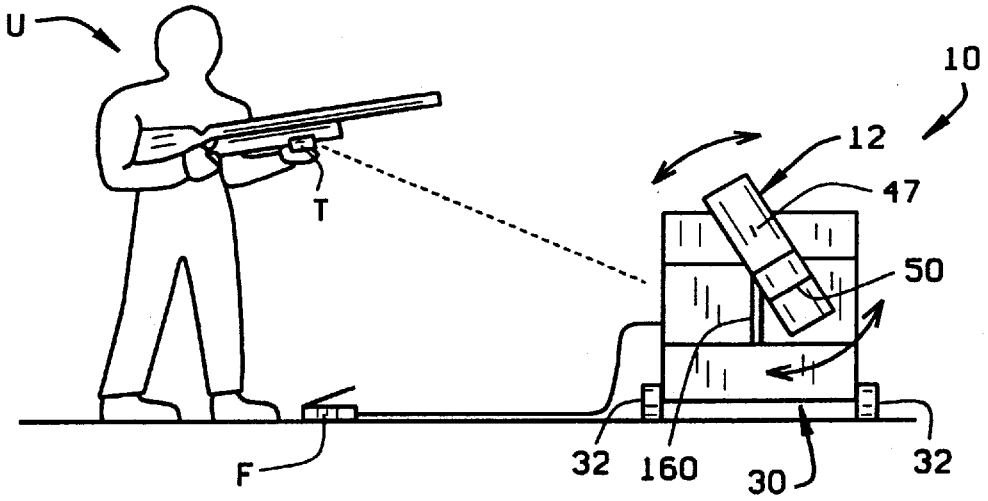
FIG. 9 illustrates remote control of the apparatus by a user.
Figure 10:
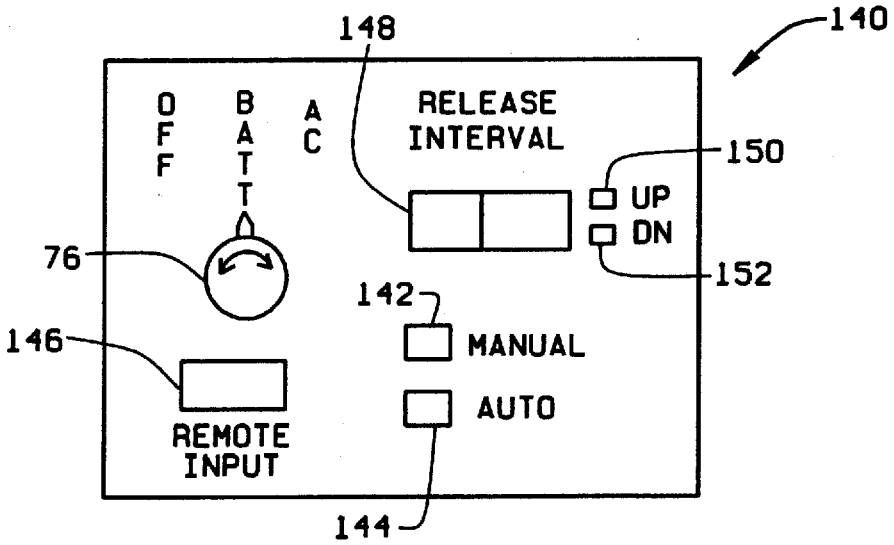
FIG. 10 illustrates a control panel of the apparatus.

As shown in FIGS. 9 and 10, operation of the feed mechanism can be either remotely controlled or pre-set so that a ball or disc is delivered to the launcher means at a predetermined interval. In FIG. 10, a control panel 140 includes a manual control switch 142 and an automatic (AUTO) feed switch 144. If the feed mechanism is to be manually operated, the user U shown in FIG. 9 can remotely trigger release of a clay pigeon, for example, into the launch arm using a foot operated switch F or a hand held infrared or sonic transmitter T. A remote input 146 on the control panel receives the remotely transmitted signal to release a clay pigeon each time an input is received. If the release is to be automatic, the user can set the interval using time display 148 and can lengthen or shorten the interval using the up (UP) and down (DN) switches 150 and 152. Thereafter, once a remote signal is sent by the user and received, a clay pigeon will automatically be released at the present release interval. This will continue until the supply of clay pigeons in the feed tube is exhausted. Control panel 140 also contains control switch 76 which is set to BATT or AC depending upon which source of power will be used to run the motor.

Launcher 12 is movable both horizontally and vertically as shown in FIG. 9, the launcher being pivotally mounted on a rotatable support 160 for this purpose. Further, side sheet 47 is rotatable through a range of positions to position opening 50 at a desired location. This allows a ball or disc to be thrown in the air or along the ground, and allows the launch angle to be a wide range of angles so many object trajectories are possible. Or, as shown in FIG. 1, wedges 162 and 164 can be attached to frame 34 of carriage 30. The wedges, including a spacer 166 used with wedge 162, allow the launcher unit to be set at a 45° launch angle, for example.

Further with respect to the apparatus, it will be understood, as previously noted, that the launcher unit, when rotating at speed, acts as a flywheel. The weight of the launcher greatly exceeds the weight of a ball or disc run through the launcher and launched. This means that there is little vibration or shock experienced when an object is thrown from the apparatus. However, as shown in FIG. 4, a counterbalance 170 is used to balance or dampen any vibration which may occur during a launch. The counterbalance is shown in FIG. 4 as a rectangular plate 172 extending oppositely launch arm 12*b*. However, it will be understood that other size and shape counterbalances can be used.

In use, the apparatus can throw objects such as baseballs at speeds on the order of 90–100 mph without damaging the ball or its cover. This means it can throw regulation baseballs for batting practice, for example, for players at all levels of the game. Similarly, it can positioned to throw the balls into the ground for fielding practice, and can throw balls upwards of 300'–350' for outfield practice. For skeet, the apparatus will throw clay pigeons distances of up to 100 yards, and the timing of the apparatus can be set such that the time between launches is short enough that two clays are simultaneously in the air. Or, the apparatus can be set to throw clays along the ground. This is similar to throwing hockey pucks along the ice for goalie or shooting practice in hockey. Again the speed at which a clay or puck is released is variable, but comparable to that experienced in competition or game situations. For tennis, balls can be lobbed or thrown at speeds approximating those realized during game situations. For handball, or similar type games in which a wall or board is used, the apparatus can throw a handball at a wall at speeds experienced during playing of a game. The apparatus is readily portable from a storage to use site, and the feed means allows a large number of baseballs, clay pigeons, hockey pucks, etc. to be launched without having to refill the feed tube. By being able to remotely control a launch and preset the interval between launches, the user is able to concentrate on his practice or play without disturbance. Or, someone can trigger the apparatus to while monitoring a player's practice or performance.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. Apparatus for launching a disc-shaped object used in the practice or play of a sport comprising:

launcher means including a constantly rotating arm rotatable about a center pivot, said arm including a flat plate on which is carried spaced channel forming segments defining a channel through which a disc-shaped object is drawn outwardly by centrifugal force toward an outer end of the arm from which the object is released, the width of the arm corresponding to the diameter of the object and the velocity of the object when it is released being a function of the length of the arm and the speed at which the arm is rotating;

feed means for holding at least one of the objects, said feed means being selectively operable to feed an object into the inlet of the arm;

drive means for constantly rotating the arm, the drive means being controllable to rotate the arm over a range of speeds so as to control the velocity of the object when it is launched; and the launcher means including means defining a circumferential wall inside of which the arm rotats, an object moving through the arm contacting an inner surface of the wall when reaching the outer end of the arm, the wall having an opening therein through which the object is released.

2. The apparatus of claim 1 further including carriage means for supporting the launcher means, feed means, and drive means.

3. The apparatus of claim 2 wherein said launcher means is pivotally supported on said carriage so the direction an object is launched can be vertically and horizontally adjusted.

4. The apparatus of claim 1 wherein the launcher means includes a liner for an inner surface of said wall, said liner being of a force absorbing material.

5. The apparatus of claim 1 wherein the feeder means includes a feed tube holding a plurality of homogeneous objects to be launched.

6. The apparatus of claim 5 further including means for releasing an object into the inlet arm of the arm.

7. The apparatus of claim 6 wherein the releasing means includes a solenoid and a lever actuated by the solenoid, the lever retaining an object in the feed tube in one position and being moved by the solenoid to a position in which said object is released into the inlet end of the arm.

8. The apparatus of claim 1 wherein the drive means includes a DC power source.

9. The apparatus of claim 8 wherein the power source is a battery.

10. The apparatus of claim 8 wherein the power source is an AC power source and an AC-DC converter.

11. The apparatus of claim 8 wherein the drive means is a DC motor and means for controlling the speed of the motor.

12. The apparatus of claim 1 further including user operated means for controlling operation of the apparatus.

13. The apparatus of claim 12 wherein the user operated means includes means for controlling operation of the apparatus.

14. The apparatus of claim 13 wherein the controller means includes means remotely operable by a user of the apparatus for controlling operation of the feeder means when an object is released from the feeder means into the arm.

15. The apparatus of claim 14 wherein the controller means further includes means for setting an interval at which objects will be released from the feed means into said launch arm.

16. The apparatus of claim 1 wherein the drive means includes an AC motor, an AC power source for powering the motor, and a battery for powering the motor using a DC-AC inverter.

* * * * *